US005530523A

United States Patent [19]

Kawabata

[11] Patent Number: 5,530,523

[45] Date of Patent: Jun. 25, 1996

[54] ELECTROPHOTOGRAPHIC APPARATUS WITH DEW CONDENSATION PREVENTING MEANS

[75] Inventor: Kazumi Kawabata, Kawasaki, Japan

[73] Assignee: Fujitsu Limited, Kawasaki, Japan

[21] Appl. No.: 462,596

[22] Filed: Jun. 5, 1995

[30] Foreign Application Priority Data

Sep. 16, 1994 [JP] Japan ..... 6-221675

[51] Int. Cl.[6] ..... G03G 15/00

[52] U.S. Cl. ..... 355/208; 355/215

[58] Field of Search ..... 355/208, 211, 355/215

[56] References Cited

U.S. PATENT DOCUMENTS

| | | | |
|---|---|---|---|
| 4,367,036 | 1/1983 | Sakamaki et al. | 355/208 |
| 4,982,225 | 1/1991 | Sakakibara et al. | 355/208 X |
| 5,144,366 | 9/1992 | Sakamoto et al. | 355/208 |

FOREIGN PATENT DOCUMENTS

| | | |
|---|---|---|
| 58-147770 | 9/1983 | Japan . |
| 59-208558 | 11/1984 | Japan . |
| 61-20967 | 1/1986 | Japan . |

*Primary Examiner*—Joan H. Pendegrass
*Assistant Examiner*—Quana Grainger
*Attorney, Agent, or Firm*—Armstrong, Westerman, Hattori, McLeland & Naughton

[57] ABSTRACT

An electrophotographic apparatus with an endless photosensitive member such as a photosensitive drum. The electrophotographic apparatus includes a dew condensation preventing device for preventing dew condensation on the photosensitive member, a temperature sensor for detecting a temperature in the vicinity of an outer surface of the photosensitive member, and a humidity sensor for detecting a humidity in the vicinity of the outer surface of the photosensitive member. The electrophotographic apparatus further includes a calculating unit for calculating a water vapor density having a given functional relationship with temperature and humidity, according to the temperature detected by the temperature sensor and the humidity detected by the humidity sensor, a storing unit for storing a preset control value, and a control unit for controlling the dew condensation preventing device according to the water vapor density calculated by the calculating unit.

10 Claims, 10 Drawing Sheets

δvs:Control Value

δvs:Control Value

ELECTROPHOTOGRAPHIC APPARATUS WITH DEW CONDENSATION PREVENTING MEANS

BACKGROUND OF THE INVENTION

1. Field of the Invention

The present invention relates to an electrophotographic apparatus such as a printer and a copying machine adopting an electrophotographic process.

In an electrophotographic apparatus, the surface resistance of a photosensitive drum is decreased by moisture adsorption of the surface of the photosensitive drum to cause the occurrence of smear. The present invention relates to a technique for efficiently preventing such smear.

2. Description of the Related Art

An electrophotographic printer is constructed so that means for charging, exposing, developing, transferring, separating, cleaning, erasing, etc. are arranged around a photosensitive drum. The surface of the photosensitive drum is uniformly charged by corona discharge, and is then exposed to light corresponding to characters or the like to be printed, thereby forming an electrostatic latent image on the photosensitive drum. The electrostatic latent image is developed with a toner (developer) to form a toner image on the photosensitive drum. Thereafter, a sheet of paper is supplied onto the toner image, and corona discharge is applied from the back side of the paper to thereby transfer the toner image formed on the photosensitive drum to the paper. Then, the paper sticking to the photosensitive drum is separated and the toner image transferred to the paper is fixed by heat, thus completing a cycle of printing. After the transfer step, the surface of the photosensitive drum is subjected to cleaning and erasing steps. Thereafter, the above series of steps are similarly repeated.

However, there is a problem such that smear occurs in the repeated use of the electrophotographic printer. The "smear" is a phenomenon that a printed image (character) is faint or the edge of a character is smudged and that when a print ratio is low, characters become illegible, whereas when the print ratio is high, they are blurred to become dark as a whole. This phenomenon termed smear occurs when the surface resistance of the photosensitive drum in its normal condition as shown in FIG. 1A is decreased by the cause to be hereinafter described to allow movement of charges around the photosensitive drum as shown in FIG. 1B.

The cause of decrease in the surface resistance of the photosensitive drum is classified into (1) deterioration of a surface layer (e.g., Se: selenium) of the photosensitive drum itself by long-term exposure of the photosensitive drum to ozone ($O_3$), and (2) ozone exposure and absorption of moisture in the atmospheric air after formation of a filming layer on the surface of the photosensitive drum. The smear occurring in the field at present is almost caused by the absorption of moisture into the filming layer.

The filming layer to be formed on the surface of the photosensitive drum will now be described. A developing unit, a cleaner, and a sheet of paper come to contact with the photosensitive drum. In such contact areas between the photosensitive drum and the other members, ozone ($O_3$) due to corona discharge acts on silica (Si) etc. in paper particles, fluorine (F) etc. in a carrier coating layer of a developer, and organic solvents and moisture in the atmospheric air as shown in FIG. 2 by the repeated use of the electrophotographic printer. As a result, a coating is formed on the surface of the photosensitive drum. This coating is called the filming layer, which is prone to absorb moisture, resulting in a decrease in the surface resistance of the photosensitive drum to cause the occurrence of smear.

As measures for preventing the smear, a technique as disclosed in Japanese Patent Laid-open No. Sho 59-208558 is known, for example. In this technique, a heat roller is brought into contact with a photosensitive drum to heat and dry the photosensitive drum at 40° C. to 200° C., thereby preventing a decrease in the surface resistance. Although the prior art technique has its own effect, it does not consider at all the relation between smear and humidity as one of factors of environment where the electrophotographic printer is installed. Accordingly, the smear cannot be efficiently prevented.

Further, as the photosensitive drum is heated continuously or periodically, a power consumption due to heating becomes large. In addition, the formation of the filming layer cannot be effectively prevented to shorten the lifetime of the photosensitive drum.

SUMMARY OF THE INVENTION

It is therefore an object of the present invention to provide an electrophotographic apparatus which can efficiently prevent the occurrence of smear, reduce a power consumption, and extend the lifetime of a photosensitive member.

In accordance with an aspect of the present invention, there is provided an electrophotographic apparatus with an endless photosensitive member, comprising dew condensation preventing means for preventing dew condensation on the photosensitive member; a temperature sensor for detecting a temperature in the vicinity of an outer surface of the photosensitive member; a humidity sensor for detecting a humidity in the vicinity of the outer surface of the photosensitive member; calculating means for calculating a water vapor density having a given functional relationship with temperature and humidity, according to the temperature detected by the temperature sensor and the humidity detected by the humidity sensor; storing means for storing a preset control value; and control means for controlling the dew condensation preventing means according to the water vapor density calculated by the calculating means.

Preferably, the dew condensation preventing means comprises a heater installed inside the endless photosensitive member. The control means controls to operate the dew condensation preventing means when a rate of increase in the calculated water vapor density is greater than the control value stored in the storing means, and otherwise stop operation of the dew condensation preventing means.

According to the present invention, only when the water vapor density as a function of temperature and humidity increases, the dew condensation preventing means is operated. Accordingly, when the probability of the occurrence of smear is high, the smear can be reliably prevented. On the other hand, when the probability of the occurrence of smear is low, the dew condensation preventing means is stopped. Accordingly, a consumption of driving power (electric power) required for prevention of dew condensation can be reduced. Furthermore, as dew condensation is prevented in the condition where the photosensitive member is readily subjected to dew condensation, the formation of a filming layer can be suppressed to thereby extend the lifetime of the photosensitive member.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

A preferred embodiment of the present invention will now be described with reference to the drawings.

Figure 1A:
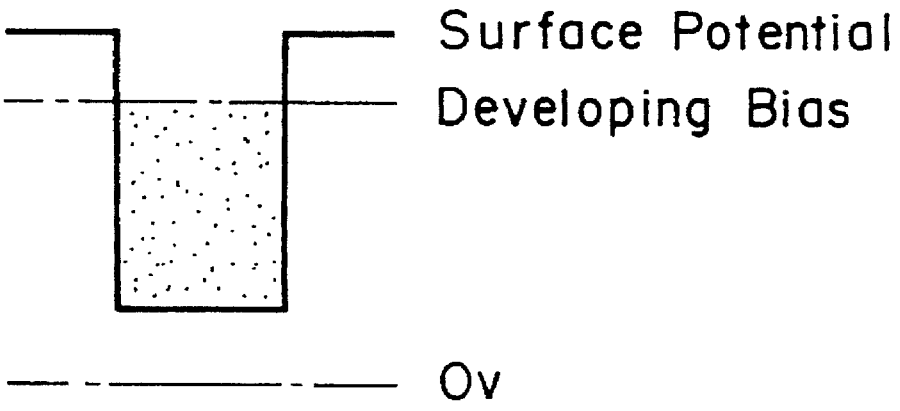
FIG. 1A is a view illustrating the surface potential of a photosensitive member in a normal condition.
Figure 1B:
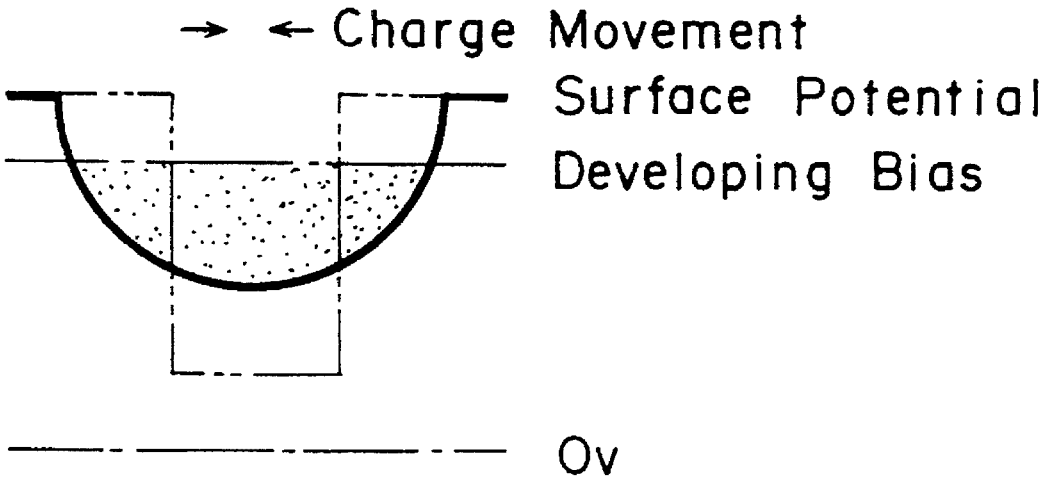
FIG. 1B is a view illustrating the surface potential of the photosensitive member when smear occurs.
Figure 2:
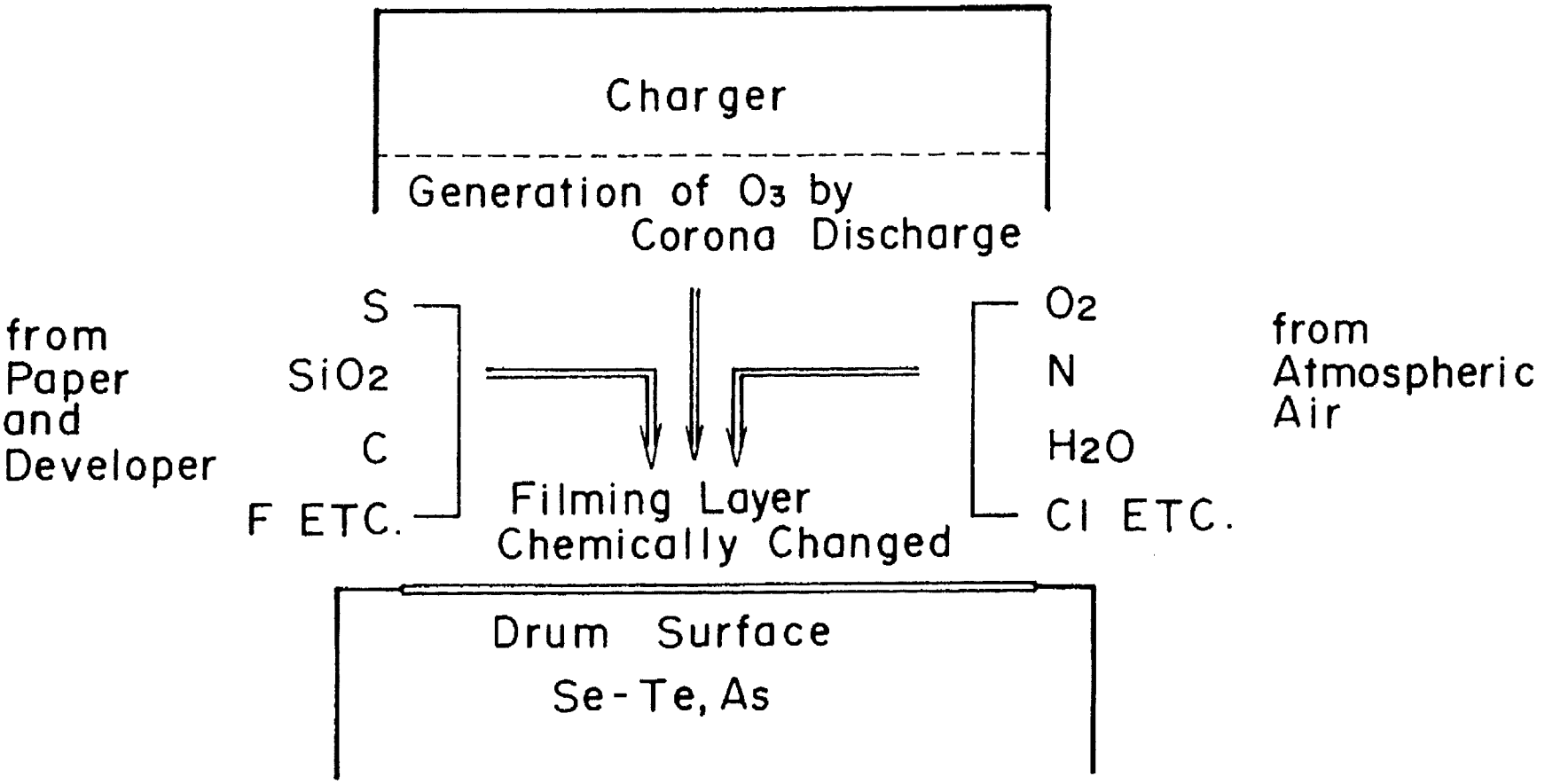
FIG. 2 is a view illustrating the formation of a filming layer.
Figure 3:
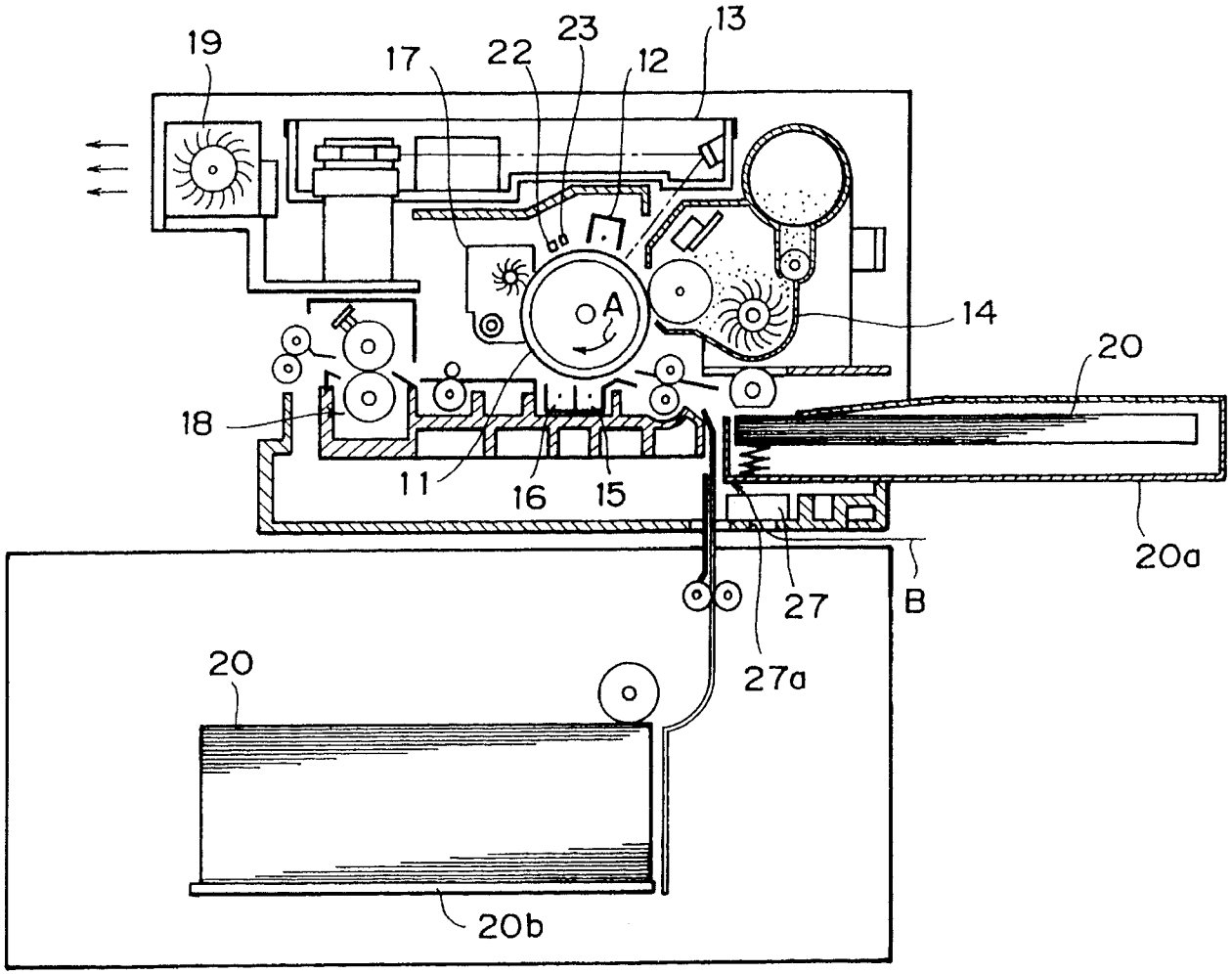
FIG. 3 is a side view showing the overall structure of an electrophotographic printer according to a preferred embodiment of the present invention.

FIG. 3 is a view showing the overall structure of an electrophotographic printer to which the present invention is applied. In FIG. 3, reference numeral 11 denotes a photosensitive drum having a cylindrical surface formed from a coating of selenium-tellurium (Se-Te), for example. There are arranged around the photosensitive drum 11 a charger (corotron) 12, an exposure unit 13, a developing unit 14, a transfer unit (corotron) 15, a separation charger (corotron) 16, a cleaner 17, etc. Reference numeral 18 denotes a fuser, and reference numeral 19 denotes a fan for ventilation and cooling in the printer.

The photosensitive drum 11 is rotated in the direction shown by an arrow A. During rotation of the photosensitive drum 11, the surface of the photosensitive drum 11 is first uniformly charged by corona discharge created by the charger 12. Then, the exposure unit 13 directs a laser beam corresponding to an image to be printed, onto the photosensitive drum 11 uniformly charged, thereby forming an electrostatic latent image on the photosensitive drum 11. This electrostatic latent image is developed with a toner (developer) by the developing unit 14, thereby forming a toner image on the photosensitive drum 11. In association with the formation of the toner image, a sheet of paper 20 is supplied from a paper cassette 20*a* or a paper hopper 20*b* and is fed to between the photosensitive drum 11 and the transfer unit 15. The transfer unit 15 applies corona discharge from the back side of the paper 20 to thereby transfer the toner image on the photosensitive drum 11 to the paper 20. After the transfer step, the paper 20 is separated from the photosensitive drum 11 by corona discharge created by the separation charger 16. Then, the toner image transferred to the paper 20 is fixed by heat from the fuser 18, thus completing a cycle of printing.

On the other hand, a remaining toner, paper particles, etc. sticking to the photosensitive drum 11 after the transfer step are removed by the cleaner 17, and charges left on the photosensitive drum 11 are removed by an erase lamp (not shown). Thereafter, the above series of steps are repeated. The toner and others removed from the photosensitive drum 11 by the cleaner 17 are sucked by air.

Figure 4:
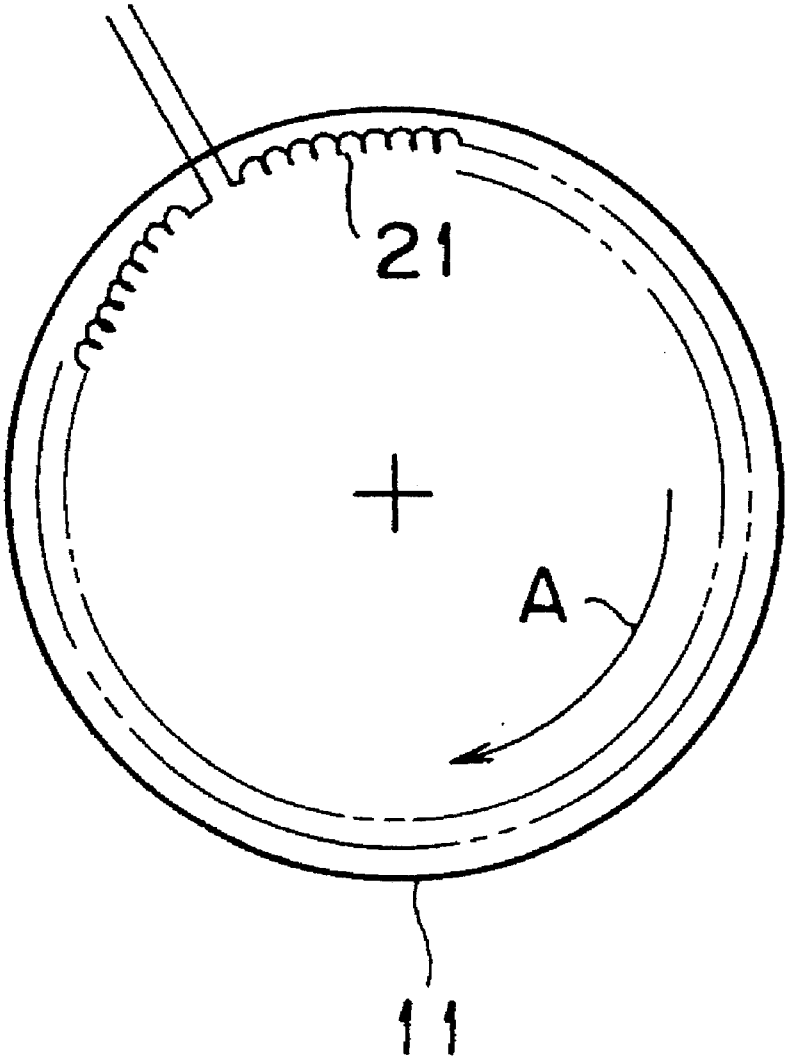
FIG. 4 is a view showing an electric heater installed inside a photosensitive drum.

A temperature sensor 22 and a humidity sensor 23 are arranged between the cleaner 17 and the charger 12 in the vicinity of the outer surface of the photosensitive drum 11. A ventilation opening 27*a* is formed at the lower portion of an upper housing storing the above-mentioned various mechanical parts, and dehumidifying means 27 is provided over the ventilation opening 27*a*. The dehumidifying means 27 introduces to dehumidify the outside air and supplies the dehumidified air into the upper housing as shown by an arrow B. The dehumidified air is passed around the photosensitive drum 11 to dry the photosensitive drum 11, and is then ejected by the fan 19. As shown in FIG. 4, an electric heater 21 is provided inside the photosensitive drum 11 to heat the surface of the photosensitive drum 11 from the inside thereof.

Figure 5:
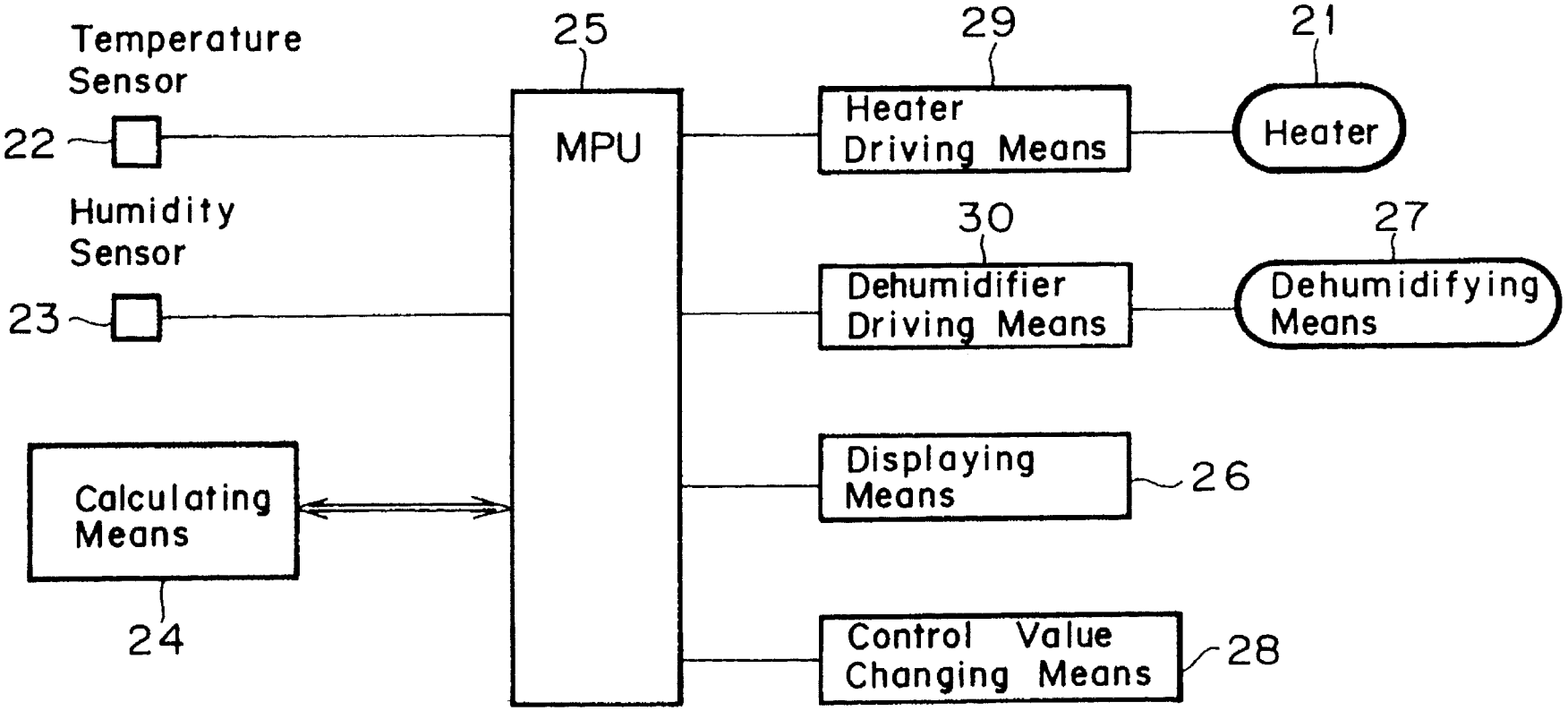
FIG. 5 is a block diagram showing the configuration of the present invention.

FIG. 5 is a block diagram showing the configuration of an essential part of the preferred embodiment according to the present invention. In FIG. 5, reference numeral 24 denotes calculating means, and reference numeral 25 denotes an MPU (microprocessing unit) as control means. A temperature detected by the temperature sensor 22 and a humidity detected by the humidity sensor 23 are input through the MPU 25 into the calculating means 24. The calculating means 24 performs calculation to be hereinafter described and obtains a water vapor density. The calculated water vapor density as the result of calculation performed by the calculating means 24 is displayed by the MPU 25 on displaying means 26 provided on a display panel or the like. Alternatively, the calculated water vapor density may be stored into a memory or the like, and it may be retrieved by a maintainer as required.

The MPU 25 controls to start and stop the electric heater 21 and the dehumidifying means 27 respectively through heater driving means 29 and dehumidifier driving means 30 according to the calculated water vapor density from the calculating means 24 and a preset control value. Control value changing means 28 such as a volume (variable resistor) is connected to the MPU 25, thereby allowing the control value to be arbitrarily changed by the control value changing means 28. While the control value is normally set to "0", it may be suitably set according to the environment where the electrophotographic printer is installed. At this time, the display of the calculated water vapor density mentioned above, for example, is an important reference data.

Figure 6:
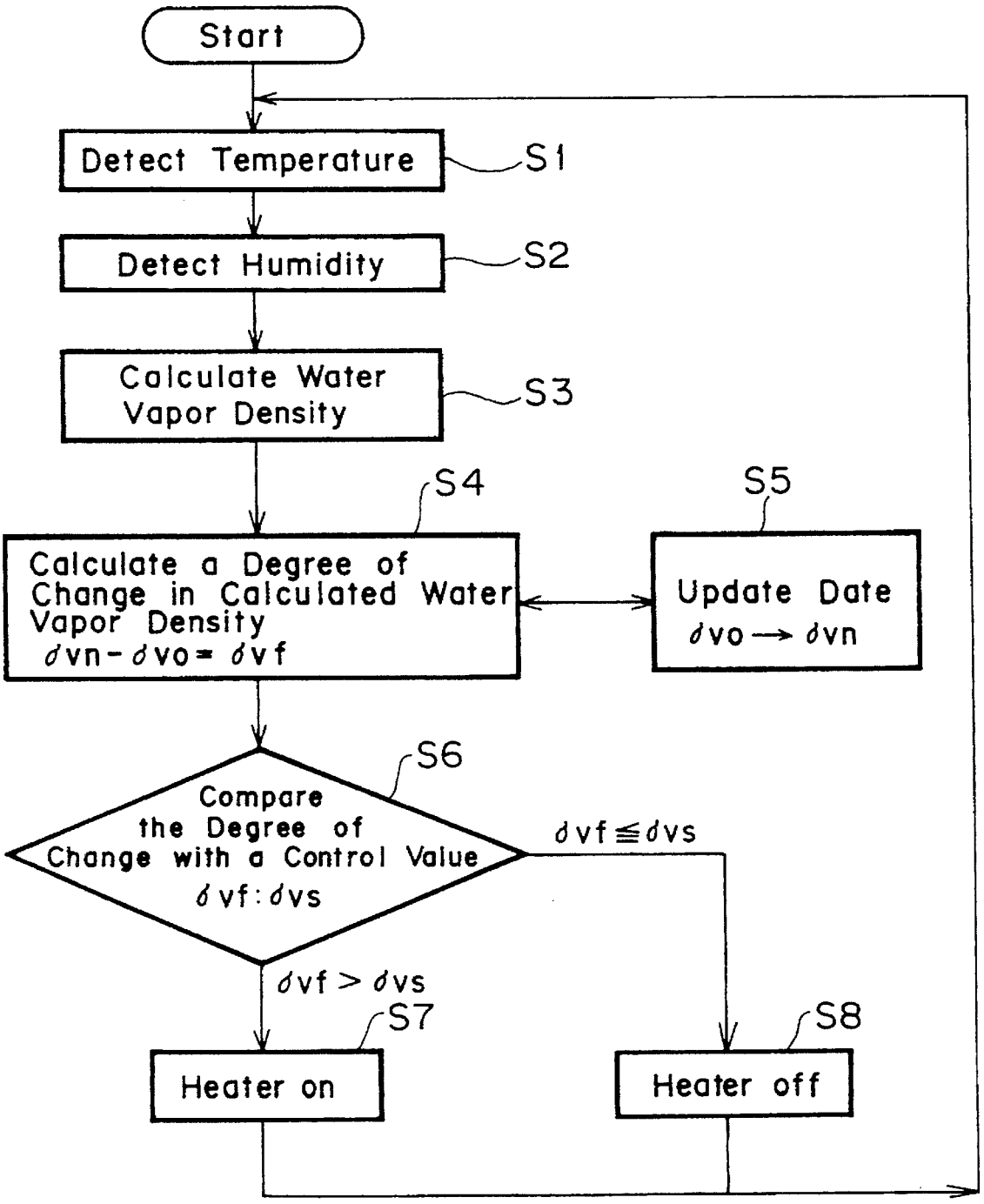
FIG. 6 is a flowchart showing the steps of a process in the preferred embodiment of the present invention.

FIG. 6 is a flowchart showing a process in the preferred embodiment according to the present invention.

First, a temperature is detected by the temperature sensor 22 (S1), and a humidity is detected by the humidity sensor 23 (S2). The detected temperature and the detected humidity are input through the MPU 25 into the calculating means 24. Then, the calculating means 24 calculates a water vapor density functionally related to a temperature and a humidity, from the detected temperature and the detected humidity (S3). More specifically, the calculating means 24 performs the following calculation.

$$\sigma v \approx (31.6675-3.40437t+0.0873603t^2)/1000 \quad (1)$$

$$\sigma = \sigma v.(H/100) \quad (2)$$

where t (°C.) represents the detected temperature from the temperature sensor, H (%) represents the detected humidity from the humidity sensor, σv ($g10^{-3}cm/1000$) represents a saturated water vapor density, and σ($g10^{-3}cm/1000$) represents the water vapor density.

Figure 7:
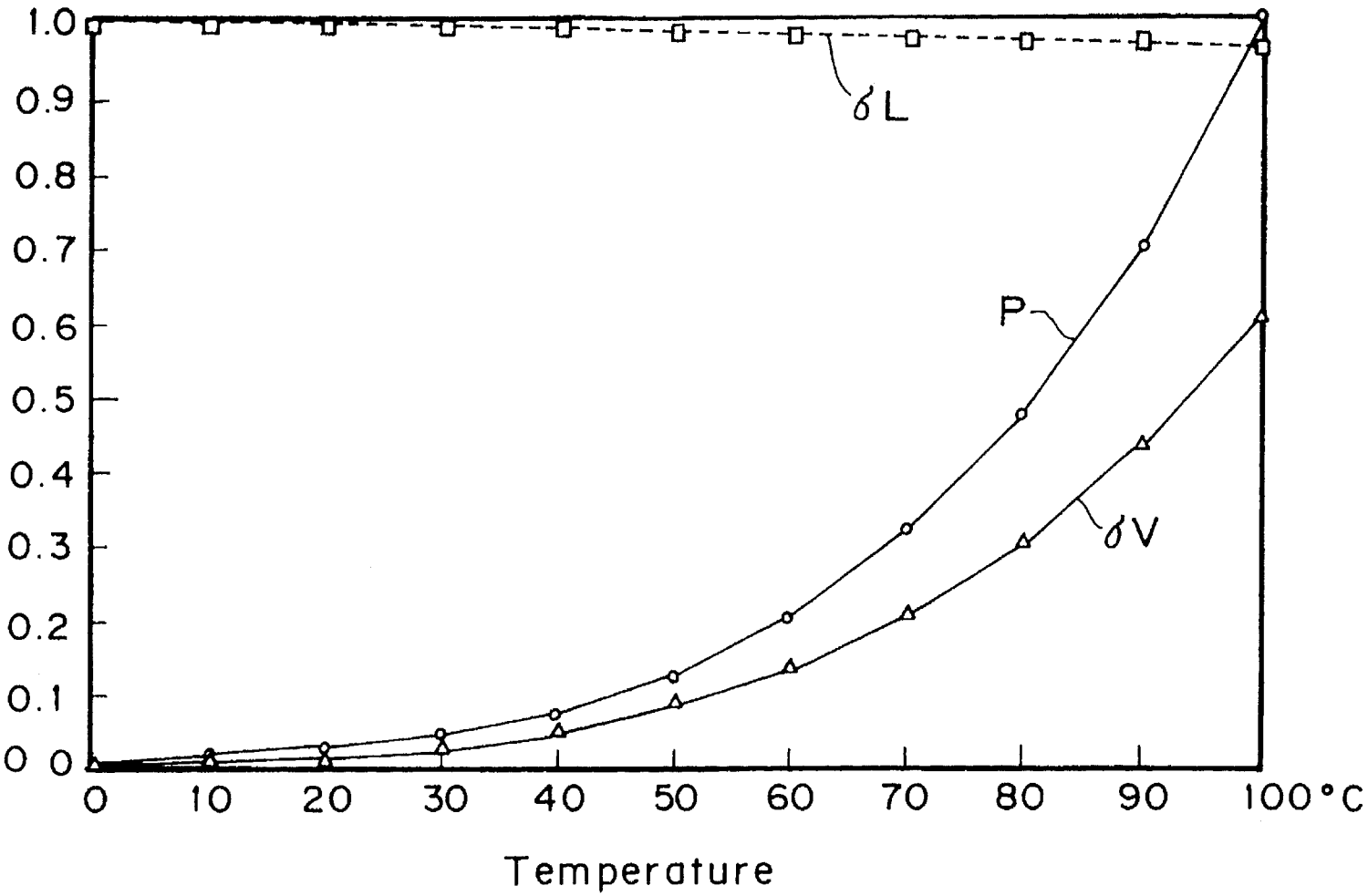
FIG. 7 is a graph showing the relation between temperature and saturated water vapor density.

Eq. (1) is an equation approximately obtained by the present inventor from the data shown in Table 1 (Scientific Table compiled by Tokyo Astronomical Observatory) which shows the relation between temperature (t) and saturated water vapor density (σv). Further, the data shown in Table 1 are graphed in FIG. 7.

TABLE 1

| Temp. | p | σL | σv |
|---|---|---|---|
| 0 | 0.00603 | 0.9998 | 0.00485 |
| 10 | 0.01211 | 0.9997 | 0.00940 |
| 20 | 0.02306 | 0.9982 | 0.01729 |
| 30 | 0.04186 | 0.9956 | 0.03037 |
| 40 | 0.0728 | 0.9922 | 0.0512 |
| 50 | 0.1217 | 0.9880 | 0.0830 |
| 60 | 0.1966 | 0.9832 | 0.1302 |
| 70 | 0.3075 | 0.9777 | 0.1982 |
| 80 | 0.4674 | 0.9718 | 0.2933 |
| 90 | 0.692 | 0.9653 | 0.4235 |
| 100 | 1.000 | 0.9583 | 0.598 |

p: saturated pressure (atm pressure)
σL: water density in saturated condition ($gcm^{-3}$)
σv: saturated water vapor density ($g10^{-3}cm^{-3}$)

The MPU 25 fetches the calculated water vapor density as the result of calculation by the calculating means 24 with a given cycle to obtain a degree of change σvf in the calculated water vapor density by subtracting a calculated water vapor density σvo currently fetched from a calculated water vapor density σvn previously fetched (S4). The value σvo is then moved to the value σvn for the next fetch of a calculated water vapor density (S5).

Although the degree of change in the calculated water vapor density is obtained by subtracting a water vapor density at the time after a given time period has elapsed from a water vapor density at a certain time in this preferred embodiment, this degree of change may be obtained by calculating a ratio of the former to the latter. The cycle of fetching the calculated water vapor density by the MPU 25 can be changed according to the installation environment or the like of the electrophotographic printer.

Then, the value σvf calculated above and a control value σvs are compared (S6). If σvf>σvs, the electric heater 21 is turned on (S7), whereas if σvf≦σvs, the electric heater 21 is turned off (S8). Thereafter, the program returns to S1 to repeat a similar process.

The start and stop of the dehumidifying means 27 are also controlled by the MPU 25. The dehumidifying means 27 is turned on at the time the electric heater 21 is turned on in S7, while being turned off at the time the electric heater 21 is turned off in S8. Alternatively, only the dehumidifying means 27 may be turned on in S7 rather than the electric heater 21, and only the dehumidifying means 27 may be turned off in S8 rather than the electric heater 21.

Figure 8:
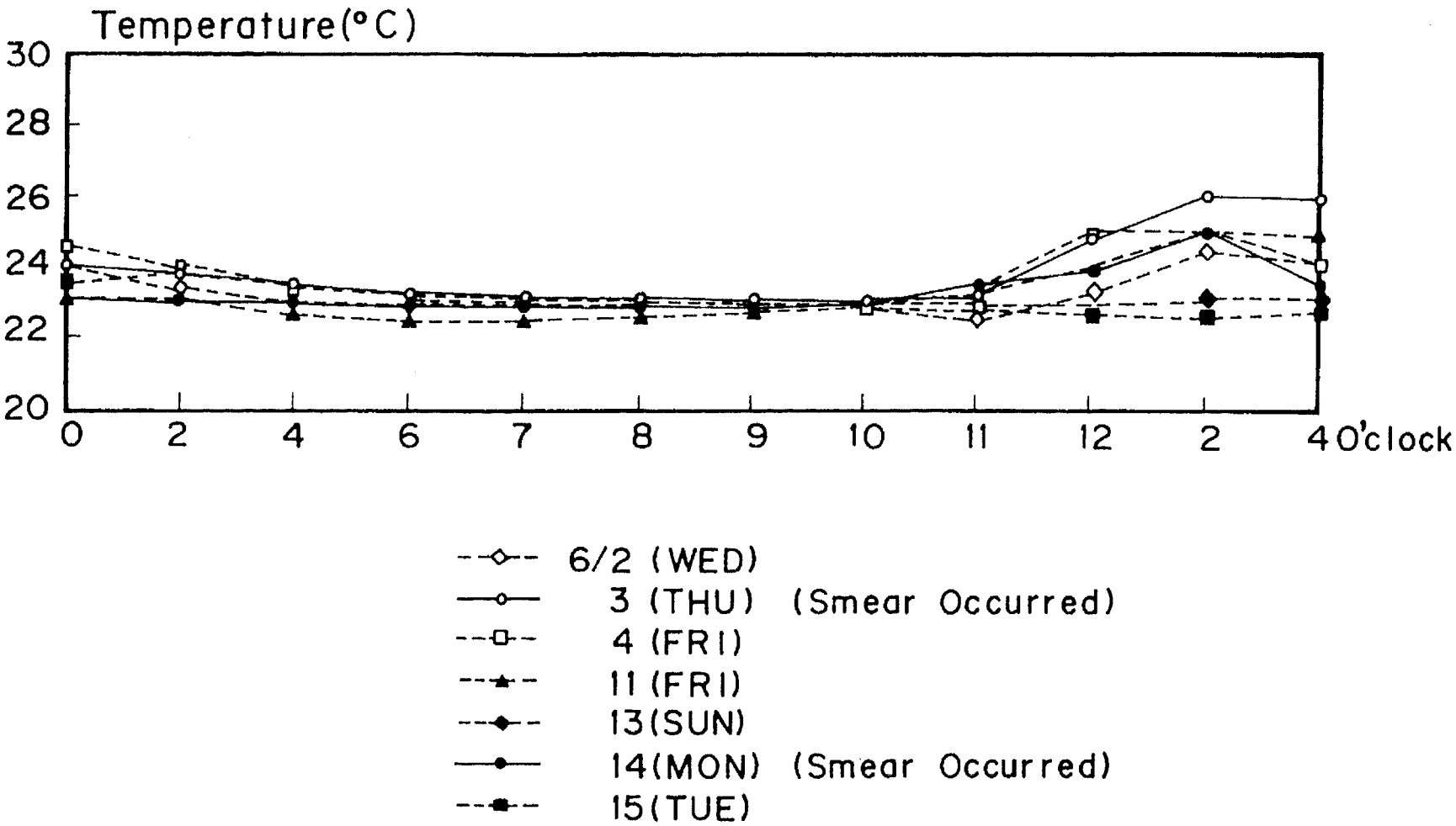
FIG. 8 is a graph of observed data showing the relation between temperature and time.
Figure 9:
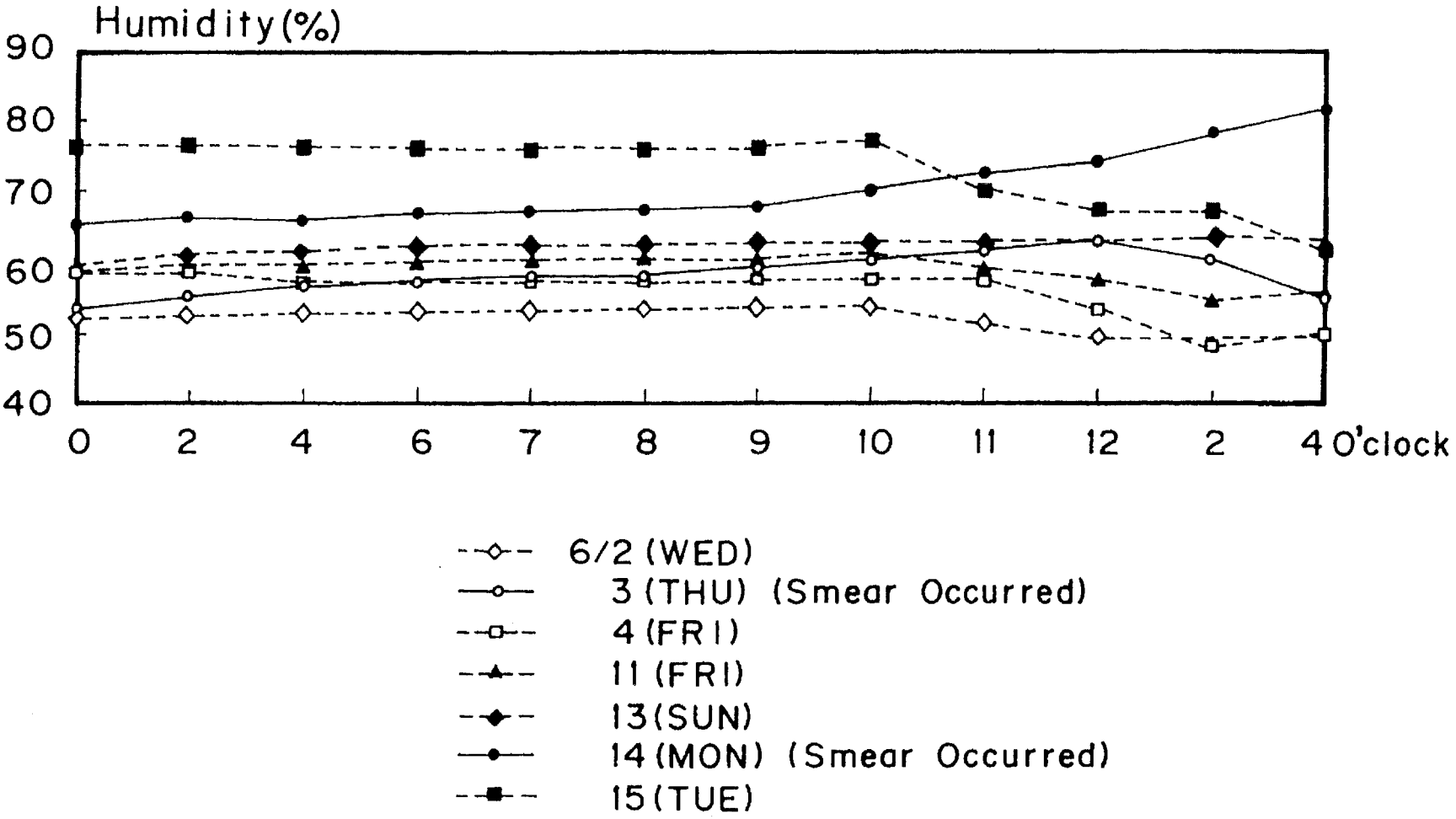
FIG. 9 is a graph of observed data showing the relation between humidity and time.
Figure 10:
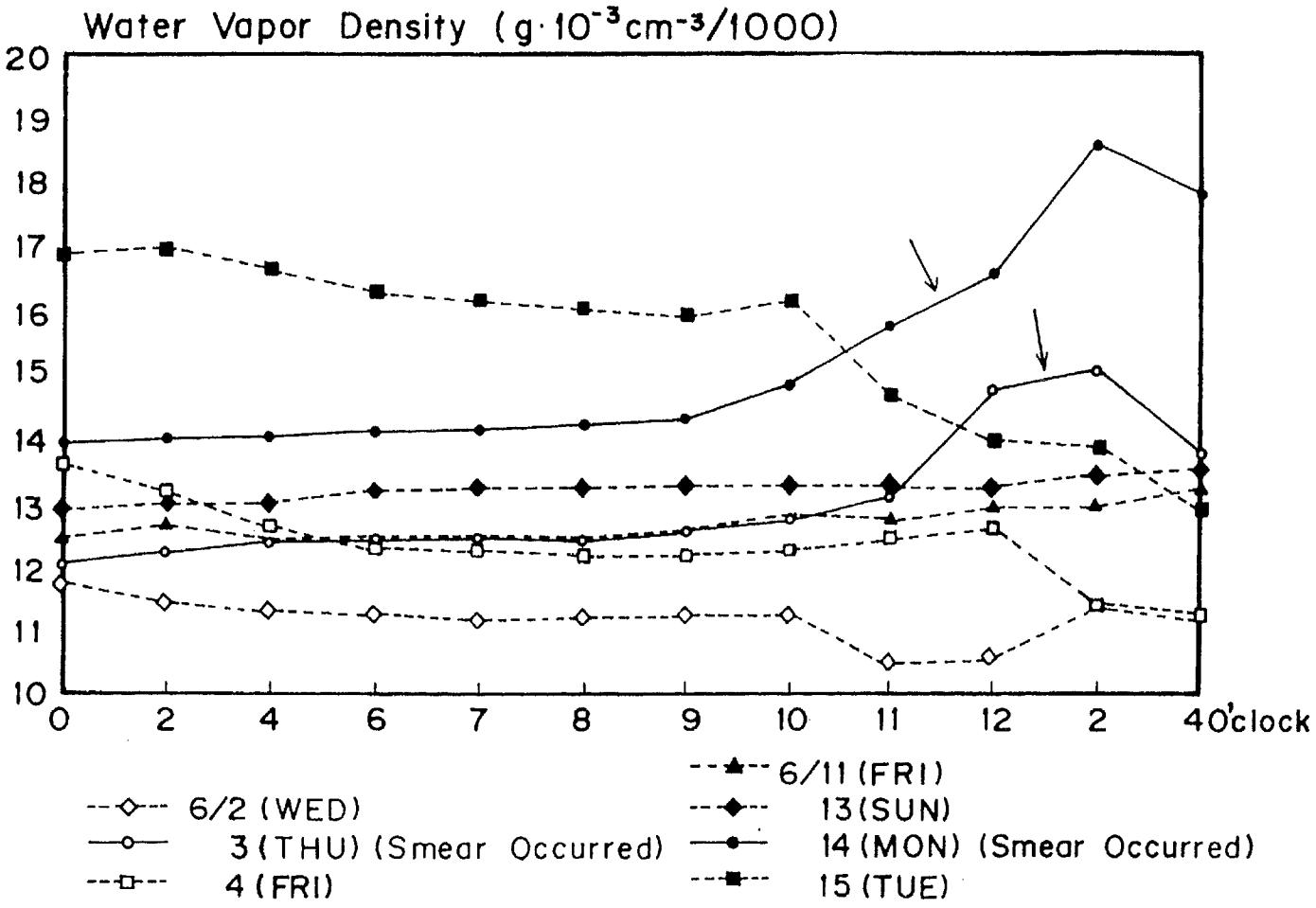
FIG. 10 is a graph of calculated data showing the relation between water vapor density and time.

The environment where smear is prone to occur was examined in the field to obtain the results as shown in FIGS. 8 to 10. FIG. 8 is a graph of observed data showing the relation between temperature and time; FIG. 9 is a graph of observed data showing the relation between humidity and time; and FIG. 10 is a graph of calculated data showing the relation between water vapor density and time, wherein the water vapor density was calculated from the observed data of time and humidity by using Eq. (1) and Eq. (2). Further, the occurrence of smear was observed at the times shown by arrows in FIG. 10.

The following facts were found from the results of examination mentioned above. That is, the occurrence of smear is not always caused merely by changes in temperature and humidity. When a water vapor density increases, the probability of the occurrence of smear becomes high. In particular, the higher the degree of change in the water vapor density, the higher the probability of the occurrence of smear. In contrast, when the water vapor density is unchanged or decreases, the probability of the occurrence of smear becomes low. In other words, when the water vapor density increases, the surface of the photosensitive drum is readily subjected to dew condensation. The present invention has been constituted on the basis of these facts in such a manner that only when the water vapor density as a function of temperature and humidity increases, the dew condensation preventing means is operated.

According to this preferred embodiment, only when the water vapor density as a function of temperature and humidity increases, that is, only when the probability of the occurrence of smear, the electric heater 21 and/or the dehumidifying means 27 are/is turned on. Otherwise, the electric heater 21 and/or the dehumidifying means 27 are/is turned off. Accordingly, dew condensation on the surface of the photosensitive drum 11 can be efficiently prevented to thereby prevent the occurrence of smear. Simultaneously, a power consumption due to heating or dehumidification can be reduced. Furthermore, as the photosensitive drum 11 is heated and/or dehumidified during an increase in water vapor density, the formation of a filming layer can be efficiently suppressed to thereby extend the lifetime of the photosensitive drum 11.

Having thus described a specific embodiment applied to an electrophotographic printer, it is to be easily understood that the present invention may be applied to a copying machine and other image forming apparatuses adopting an electrophotographic process.

As described above, the present invention can provide an electrophotographic apparatus which can efficiently prevent the occurrence of smear, reduce a power consumption, and extend the lifetime of the photosensitive member.

What is claimed is:

1. An electrophotographic apparatus with an endless photosensitive member, comprising:

dew condensation preventing means for preventing dew condensation on said photosensitive member;

a temperature sensor for detecting a temperature in the vicinity of an outer surface of said photosensitive member;

a humidity sensor for detecting a humidity in the vicinity of the outer surface of said photosensitive member;

calculating means for calculating a water vapor density having a given functional relationship with temperature and humidity, according to said temperature detected by said temperature sensor and said humidity detected by said humidity sensor;

storing means for storing a preset control value; and control means for controlling said dew condensation preventing means according to comparison of said preset control value with said water vapor density calculated by said calculating means.

2. An electrophotographic apparatus according to claim 1, wherein said control means controls to operate said dew condensation preventing means when a rate of increase in said calculated water vapor density is greater than said control value, and otherwise stop operation of said dew condensation preventing means.

3. An electrophotographic apparatus according to claim 2, wherein said dew condensation preventing means comprises a heater installed inside said photosensitive member.

4. An electrophotographic apparatus according to claim 1, further comprising a housing having a ventilation opening, and dehumidifying means mounted at said ventilation opening;

wherein said dehumidifying means is controlled by said control means according to said water vapor density calculated by said calculating means.

5. An electrophotographic apparatus with an endless photosensitive member, comprising:

dew condensation preventing means for preventing dew condensation on said photosensitive member;

a temperature sensor for detecting a temperature in the vicinity of an outer surface of said photosensitive member;

a humidity sensor for detecting a humidity in the vicinity of the outer surface of said photosensitive member;

calculating means for calculating a water vapor density having a given functional relationship with temperature and humidity, according to said temperature detected by said temperature sensor and said humidity detected by said humidity sensor;

storing means for storing a preset control value; and control means for controlling said dew condensation preventing means according to comparison of said preset control value with said water vapor density calculated by said calculating means, said control means controlling to operate said dew condensation preventing means when a rate of increase in said calculated water vapor density is greater than said control valve, and otherwise stop operation of said dew condensation preventing means.

6. An electrophotographic apparatus according to claim 5, wherein said dew condensation preventing means includes dehumidifying means.

7. An electrophotographic apparatus according to claim 5, further comprising displaying means for displaying the calculated water vapor density.

8. An electrophotographic apparatus according to claim 5, wherein the calculating the water vapor density is performed for each given time interval.

9. An electrophotographic apparatus according to claim 5, wherein said calculating means performs the following calculation:

$$\sigma v \approx (31.6675-3.40437t+o.0873603t^2)/100$$

$$\sigma=\sigma v.(H/100)$$

where t(°C.) represents the detected temperature from the temperature sensor, H(%) represents the detected humidity from the humidity sensor, σv(g10-3 cm/1000) represents a saturated water vapor density, and σ(g10-3 cm/1000) represents the water vapor density.

10. An electrophotographic apparatus with an endless photosensitive member, comprising:

dew condensation preventing means for preventing dew condensation on said photosensitive member, said dew condensation preventing means including a heater installed inside said photosensitive member;

a temperature sensor for detecting a temperature in the vicinity of an outer surface of said photosensitive member;

a humidity sensor for detecting a humidity in the vicinity of the outer surface of said photosensitive member;

calculating means for calculating a water vapor density having a given functional relationship with temperature and humidity, according to said temperature detected by said temperature sensor and said humidity detected by said humidity sensor;

storing means for storing a preset control value; and control means for controlling said dew condensation preventing means according to comparison of said preset control value with said water vapor density calculated by said calculating means, said control means controlling to operate said dew condensation preventing means when a rate of increase in said calculated water vapor density is greater than said control valve, and otherwise stop operation of said dew condensation preventing means.

* * * * *